United States Patent [19]

Bernard

[11] Patent Number: 4,783,102

[45] Date of Patent: Nov. 8, 1988

[54] LATCH, IN PARTICULAR FOR A MOTOR VEHICLE DOOR

[75] Inventor: Vincent Bernard, Anould, France

[73] Assignee: Rockwell-CIM, France

[21] Appl. No.: 126,533

[22] Filed: Nov. 30, 1987

[30] Foreign Application Priority Data

Dec. 2, 1986 [FR] France ..... 86 16819

[51] Int. Cl.[4] ..... E05C 3/26

[52] U.S. Cl. ..... 292/216; 292/341.17

[58] Field of Search ..... 292/200, 216, 341.17

[56] References Cited

U.S. PATENT DOCUMENTS

| | | | |
|---|---|---|---|
| 3,334,934 | 8/1967 | Sandor | 292/216 |
| 3,347,584 | 10/1967 | Johnstone | 292/216 X |
| 3,386,761 | 6/1968 | Johnstone et al. | 292/216 X |
| 3,705,505 | 12/1972 | Landow et al. | 292/216 X |
| 4,202,571 | 5/1980 | Nishikoori | 292/216 |

*Primary Examiner*—Kenneth J. Dorner

*Assistant Examiner*—Peter R. Brown

[57] ABSTRACT

The latch comprises a pivotal fork member adapted to receive a keeper (4), an intermediate catch (6) adapted to cooperate with the fork member (1) for maintaining the latter in the latching position, and a main catch (14) cooperative with the catch (6) for maintaining the latter in its position for locking the fork member (1), these elements being biased by return springs. The main catch (14) is provided with an arm (19) which, at the beginning of the latch opening sequence, and if the latch is in a bad state of maintenance, comes to bear against the arm (8) of the intermediate catch (6) and urges the latter to pivot in the direction for releasing the fork member (1). The presence of the arm (19) on the main catch (14) guarantees the opening of the latch without difficulty throughout the life of the vehicle, notwithstanding the hindrance that the progressive disappearance of the lubrication and the accumulation of dust might create in respect of this opening.

1 Claim, 3 Drawing Sheets

LATCH, IN PARTICULAR FOR A MOTOR VEHICLE DOOR

The present invention relates to a latch for, in particular, motor vehicle doors.

A motor vehicle door latch is known from French Pat. No. 2 402 757 of the type comprising, disposed in a case, a pivotal fork member adapted to receive a keeper, an intermediate catch also pivotally mounted and including two arms one of which is cooperative with one end of the fork member for locking the latter in the latching position, and a main catch pivotable between a position in which it cooperates with the intermediate catch for locking the latter in its position for locking the fork member and a position for releasing the intermediate catch. With the latch locked in this way, it is sufficient to pivot the main catch to release the intermediate catch, which in turn is free to pivot in the direction for releasing the fork member and opening the latch.

Now, in the course of the operating life of a vehicle, an evolution of various factors is observed, in particular the following: disappearance of the grease coating the component parts of the latch, appearance of dust, deterioration of the sliding surfaces, alteration of the sealing elements and of the forces applied thereto. The conjunction of the evolution of these various factors may result, when opening the latch, in a jamming of the intermediate catch, which may prevent the opening of the door, or at least hinder this opening, with, for the user, an unpleasant impression when operating the latch (noise, impressions of friction, greater forces, necessity to pull the door in the opening direction).

An object of the invention is therefore to overcome this problem so as to avoid any hindrance or obstacle to the opening of the latch under satisfactory conditions throughout the life of the vehicle.

The latch provided by the invention is of the type comprising, disposed in a case, a pivotal fork member movable between an unlatching position to which it is elastically biased, and a latching position in which it cooperates with a keeper, an intermediate catch having two arms, mounted to be pivotable between a position in which the first of said arms locks the fork member in its latching position and a releasing position in which the fork member is in the unlocked position, said intermediate catch being elastically biased to its fork locking position, said latch further comprising a pivotal main catch cooperative with the end portion of the second arm of the intermediate catch for maintaining the latter in bearing relation to the fork member.

According to the invention, the main catch is provided with an arm adapted to be capable, if the latch is in a bad state owing to insufficient lubrication or the presence of dust, of urging the second arm of the intermediate catch in the direction opposed to that in which it is elastically biased, when said main catch is pivoted for releasing the intermediate catch and consequently opening the latch, so that said arm of the main catch turns the intermediate catch in the direction in which the intermediate catch unlocks the fork member.

It will be understood that, under these conditions, the factors mentioned hereinbefore which oppose the normal opening of the latch, become inoperative and the satisfactory opening of the latch is guaranteed.

Further features and advantages of the invention will be apparent from the following description, given with reference to the accompanying drawings which illustrate an embodiment of the invention by way of a non-limiting example. In the drawings.

Figure 2:
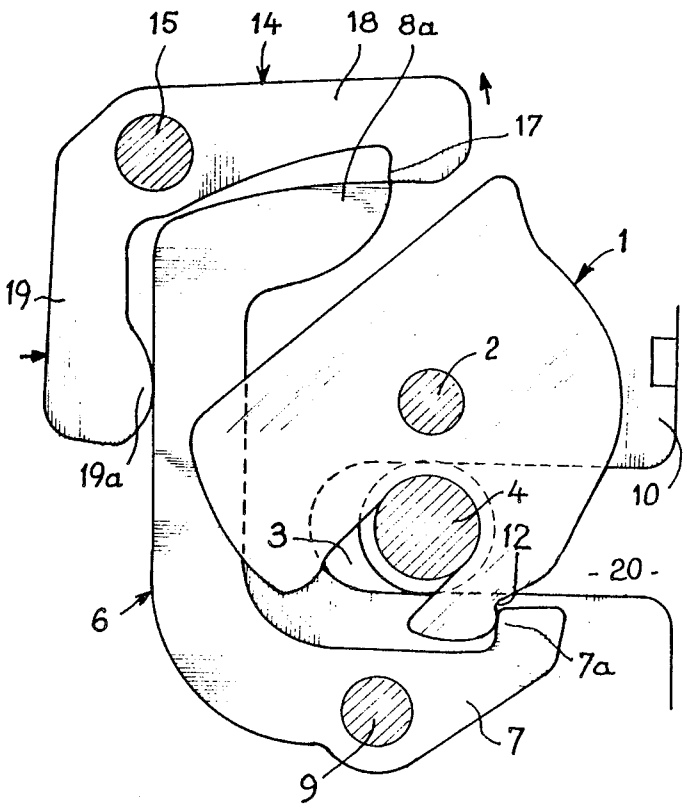
FIG. 2 is an elevational view similar to FIG. 1 of the first stage of the unlocking of the fork member in starting at the position of FIG. 1, the main catch being raised.
Figure 1:
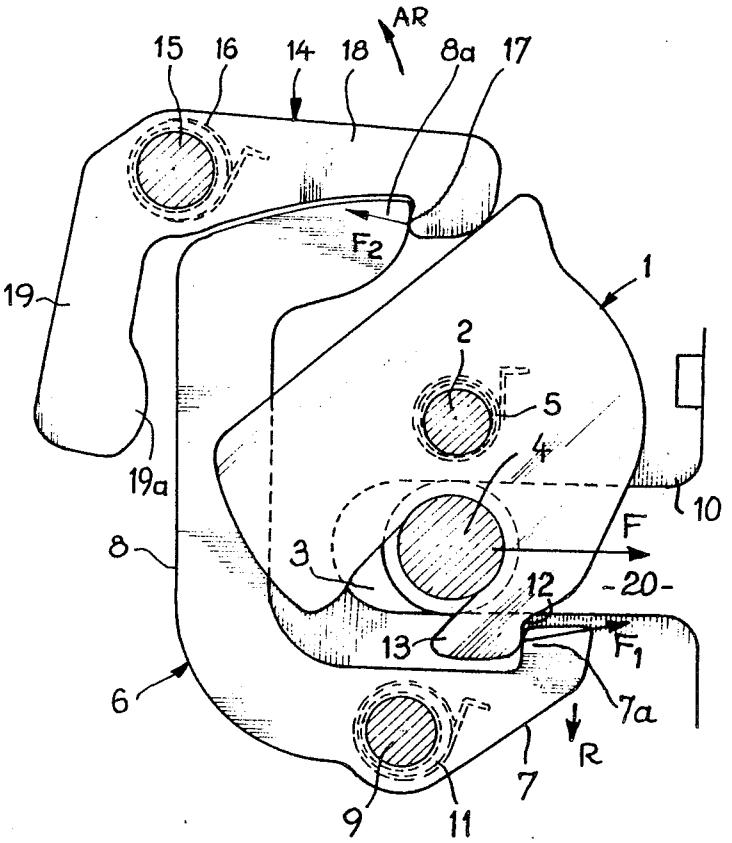
FIG. 1 is an elevational view of an embodiment of the latch according to the invention in the locked position, the case not being shown in order to simplify the drawing.
Figure 5:
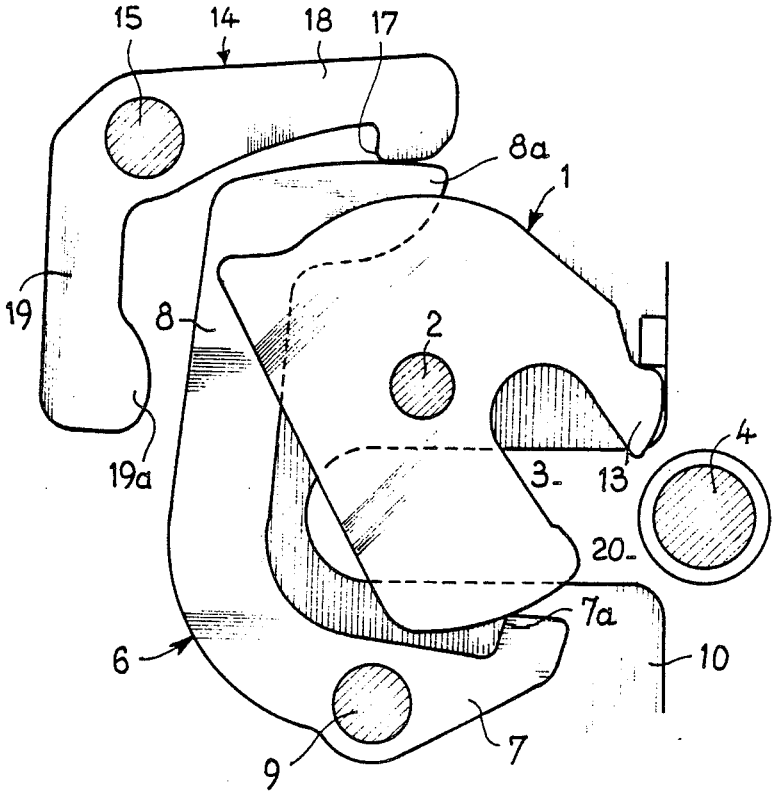
FIG. 5 shows the latch in the completely opened position, after the return of the main catch to a position in which it bears against the intermediate catch.

The latch shown in the drawings is intended in particular for motor vehicle doors, and comprises, disposed in a case 10, the following elements:

a fork member 1 pivotally mounted on a pin 2, this fork member having a recess 3 adapted to receive a keeper 4 and being elastically biased to its position for unlatching the latch (FIG. 5) by a spring 5 coaxial with the pin 2;

an intermediate catch 6 having two arms 7, 8 mounted to be pivotable about a pin 9 and elastically biased by a spring 11 wound around this pin to a position in which the end nose portion 7*a* of its first arm 7 is engaged in a peripheral notch 12 of a branch 13 of the fork member 1, so as to maintain the latter in the locked position (FIG. 1) in which it traps the keeper 4 in its recess 3;

a main catch 14 also mounted to be pivotable about a pin 15 and elastically biased by a spring 16 wound around this pin to a position in which the end nose portion 17 of the catch 14 comes to bear against the end portion 8*a* of the second arm 8 so as to maintain the intermediate catch 6 in its position in which it locks the fork member 1 (FIG. 1).

The pins 2, 9 and 15 are fixed to the case 10 and the corresponding return springs 5, 11 and 16 have their ends fixed on one hand to the case and on the other hand to the elements 1, 6, 14 that they tend to rotate.

In the locking position of the latch shown in FIG. 1, the keeper 4 is biased against the rounded end of the recess 3, i.e. toward the right as viewed in the drawing, by the reaction F of the sealing elements of the door, and it is retained by the fork member 1 which is maintained in a locked position by the intermediate catch 6. The force F1 of contact of the fork member 1 against the catch 6 tends to turn the latter in the clockwise direction R against the return force of its spring 11, i.e. in the unlocking direction. The main catch 14 has for function to prevent the unlocking of the latch by locking the intermediate catch 6 by its end nose portion 17 which exerts on the end 8*a* of the catch 6 a force F2 in a direction passing through the axis of rotation of the main catch 14.

Owing to the ratio of the lever arms of the intermediate catch 6, determined by the two arms 7 and 8, the force F2 represents only a small proportion of the force F. Moreover, the force F2 produces on the main catch 14 a torque which tends to turn the latter in the clockwise direction, that is to say this torque maintains the main catch 14 in the locked position.

The main catch 14 is constituted by two arms 18, 19 the first arm 18 having at its end the nose portion 17 for locking the catch 16. The second arm 19 forms with the arm 18 an elbow and is provided at its end with a boss 19*a* capable of coming to bear against the second arm 8 of the intermediate catch 16 during the opening of the latch.

The latch opening sequence is the following:

With the latch in the locked condition shown in FIG. 1, the main catch 14 is raised by an exterior means known per se and not shown in the drawing, by turning it in the counter-clockwise direction AR until it completely releases the intermediate catch 6, this situation being shown in FIG. 2.

At this moment, the force F2 has disappeared and only the force F1 remains which biases the intermediate catch 6 in the unlocking direction (clockwise direction in the drawings). At the same time, owing to the pivoting of the main catch 14, the boss 19*a* of its arm 19 comes into contact with the arm 8 of the catch 6 (FIG. 2).

Figure 3:
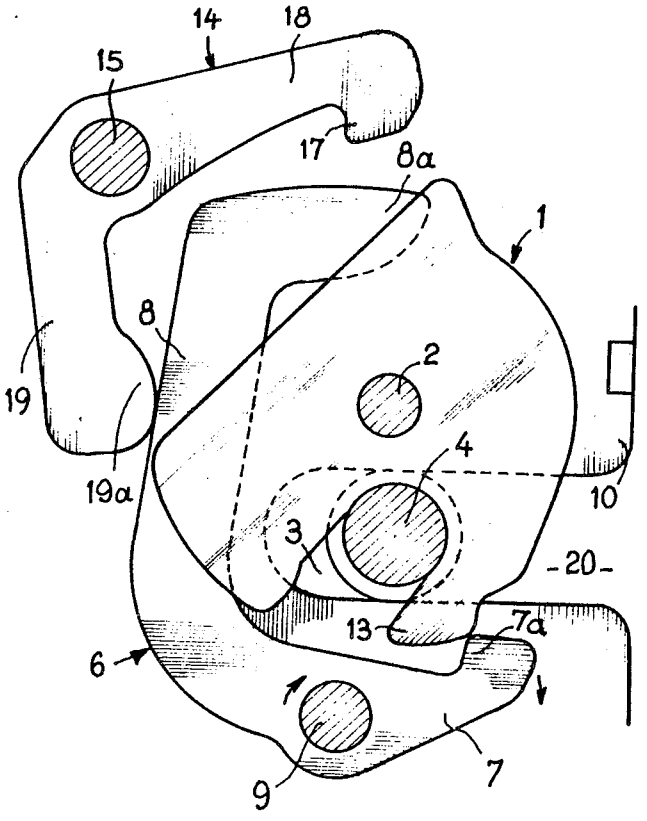
FIG. 3 illustrates the second stage of the opening of the latch, in which the arm of the main catch pivots the intermediate latch in the direction which allows the release of fork member.

If the latch is in a good state of maintenance (suitable lubrication, absence of dust, etc . . . ), as soon as the position of FIG. 2 is reached, the force F1 is sufficient to pivot the intermediate catch 6 in the clockwise direction for unlocking the latch. If the latch is jammed owing to a bad condition (insufficient lubrication, dust, etc . . . ), the force F1 is insufficient with the pivoting of the main catch 14 continuing, the boss 19*a* urges the intermediate catch 6 and causes it to pivot in the clockwise direction (FIG. 3) so that its nose portion 7*a* is withdrawn from the notch 12 and starts to release the fork member 1 (FIG. 3).

Figure 4:
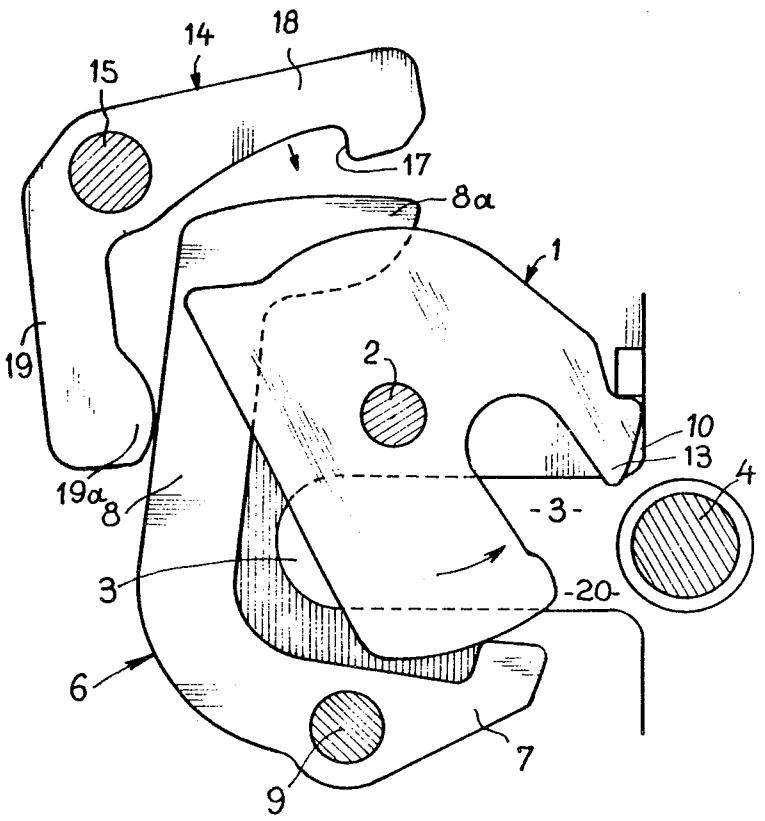
FIG. 4 illustrates the following stage of the opening, in which, after having been released by the intermediate catch, the fork member has completely pivoted and the keeper is released.

In the following stage (FIG. 4), the arm 13 of the fork member 1 has completely escaped from the arm 7 of the intermediate catch 6, so that, under the effect of its return spring 5, the released fork member 1 pivots in the counter-clockwise direction and completely releases the keeper 4. Under this condition, the end nose portion 7*a* remains applied against the surface of the fork member 1 under the effect of the return spring 11, and more precisely on the branch of the fork member 1 opposed to its branch 13 relative to the recess 3. Furthermore, the actuating force exerted on the main catch 14 maintains its boss 19*a* in bearing relation against the branch 8 of the catch 6.

When the main catch 14 is released (FIG. 5), the latter pivots in the clockwise direction under the action of its spring 16 so that its boss 19*a* moves away from the branch 8 and its arm 18 returns to a position in which its end 17 bears on the end portion 18*a* of the catch 6.

The latch is then completely open and may be locked by a sequence which is the opposite of that just described if the latch is moved toward the keeper 4 so that the latter is made to enter the recess 3.

What is claimed is:

1. A latch for a motor vehicle door for cooperation with a keeper comprising:

a case for mounting a pivotal fork member having two branches which is adapted to receive said keeper, an intermediate catch member, and a main catch;

said keeper cooperating with said pivotal fork member for moving said fork member between an unlatching position and a latching position relative to said keeper;

a first pin for pivotally mounting said fork member;

a recess within said fork member between the two branches adapted to receive said keeper;

elastic biassing means for said fork member consisting of a spring which is coaxial with said pin which biasses said fork member to a position for unlatching the latch;

said intermediate catch having two arms, a first arm having a projection thereon, and a second arm extending perpendicularly to said first arm;

a second pin mounting said intermediate catch to said case, said second pin being located below said first pin;

a spring wound around said second mounting pin for biassing said intermediate catch member to a position wherein the projection of the first arm engages in a peripheral notch formed in one branch of the fork member to maintain the fork member in a locked position in which the keeper is trapped in the recess of said fork member;

said main catch comprising an L-shaped member one arm of which has an abutting surface at the end thereof which bears against the end of the second arm of said intermediate catch to thereby maintain the intermediate catch in a locking position for locking the fork member;

said main catch pivotally mounted to the case by means of a third pin located at the junction of the arms of the main catch, and having a spring mounted coaxially with said third pin to bias the main catch to a position where the abutting surface engages the intermediate catch, said first pin said second pin, and said third pin all being fixed to an interior wall of said case and the spring for each of said pins having one end fixed to said case and the other end fixed to said fork member, intermediate catch and main catch respectively, so that with the keeper in the locking position, said keeper is maintained within the recess in said fork member with the intermediate catch having the projection formed on the first arm engaging the peripheral notch of the branch of said fork member so that the intermediate catch tends to hold the fork member in a fixed locking position against the return force of the spring while said main catch prevents the unlocking of the latch by means of its abutting surface engaging the second arm of the intermediate catch;

said other arm of said L-shaped main catch member having a boss at the end thereof for bearing against the second arm of the intermediate catch during the opening of the latch to positively rotate the intermediate catch in a direction in which the projection on the first arm disengages from the peripheral notch on the fork member thereby allowing the fork member to rotate to an unlocked position wherein the keeper is released.

* * * * *